US006663420B1

(12) United States Patent
Xiao

(10) Patent No.: US 6,663,420 B1
(45) Date of Patent: Dec. 16, 2003

(54) ADAPTER FOR EXCHANGING DATA AND TRANSMITTING POWER BETWEEN PC AND PORTABLE DEVICE

(75) Inventor: Hui Xiao, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/325,172

(22) Filed: Dec. 19, 2002

(30) Foreign Application Priority Data

Nov. 15, 2002 (TW) ..... 91218338 U

(51) Int. Cl.[7] ..... H01R 11/00
(52) U.S. Cl. ..... 439/502; 307/150
(58) Field of Search ..... 439/502, 620, 439/79, 540.1, 638; 307/149, 150, 151

(56) References Cited

U.S. PATENT DOCUMENTS 5,584,709 A * 12/1996 Kiat ..... 439/79
6,184,652 B1 2/2001 Yang
6,206,724 B1 * 3/2001 Leung ..... 439/540.1
6,211,649 B1 4/2001 Matsuda
6,371,809 B1 * 4/2002 Chun-Yuan ..... 439/607
6,534,885 B2 * 3/2003 Nakagawa et al. ..... 307/150

* cited by examiner

*Primary Examiner*—Gary Paumen
*Assistant Examiner*—James R. Harvey
(74) *Attorney, Agent, or Firm*—Wei Te Chung

(57) ABSTRACT

An adapter (100) is adapted to connect a Personal Computer (PC) to a portable device (such as a mobile phone) to support data exchange and power transmitting therebetween. The adapter comprises a first connector (10), a second connector (20), and a cable (30) electrically connecting the two connectors. The first connector electrically connects to the PC, and the second connector electrically connects to the portable device. A power converting circuit (40) and a data transmitting circuit (50) are disposed on a printed circuit board (PCB) housed in the second connector. Power from the PC passes through the first connector, the cable, the power converting circuit, and through the second connector to the portable device. Data is exchanged between the PC and the portable device via the first connector, the cable, the data transmitting circuit, and the second connector.

1 Claim, 3 Drawing Sheets

ADAPTER FOR EXCHANGING DATA AND TRANSMITTING POWER BETWEEN PC AND PORTABLE DEVICE

BACKGROUND OF THE INVENTION

1. Field of the Invention

This invention relates to an adapter, and more particularly to an adapter for connecting a Personal Computer (PC) and a portable device (such as a mobile phone).

2. Description of Related Art

With recent technological improvements, portable devices, such as mobile phones, have gained more functions, and can now exchange data with a PC by using an adapter. The portable device has a port for connecting to the adapter, and the port has a plurality of contacts disposed therein. The contacts include power contacts and data contacts. Adapters currently on the market include power adapters and data adapters which each have a plug for connecting to a portable device, but the plugs differ in the location and number of the contacts used in the plug. Power adapters are used to charge the portable device; data adapters are used to exchange the data with a PC. However, if a portable device which is low in power is exchanging data with a PC using a data adapter, data exchange may stop and the portable device may first need to be recharged using a power adapter. Switching between the power adapter and data adapter is inconvenient.

Universal Serial Bus (USB) interfaces are widely used on PCs today, so many data adapters have a standard USB plug for connecting to a standard USB port on the PC. Standard USB ports also include power terminals. An improved adapter providing power and data through a USB interface between a portable device and a PC is desired so that the PC can transmit power to the portable device while the portable device and the PC exchange data.

SUMMARY OF THE INVENTION

A main object of the present invention is to provide an adapter for exchanging data and transmitting power between a portable device and a PC at the same time.

Another object of the present invention is to provide an adapter having a simple configuration which is easy to use.

To fulfill the above-mentioned objects, an adapter according to the present invention comprises a first connector electrically connecting to a PC, a second connector electrically connecting to a portable device, and a cable electrically connecting the two connectors. A power converting circuit and a data transmitting circuit are disposed on a printed circuit board (PCB) housed in the second connector. The power from the PC passes through the first connector, then through the power converting circuit of the second connector to the portable device. The data is exchanged between the PC and the portable device via the adapter at the same time that the PC is recharging the portable device.

Since the adapter has both a power converting circuit and a data transmitting circuit, it enables the portable device to exchange data with the PC while being charged by the PC. The adapter both has a simple configuration and is easy to use.

Other objects, advantages and novel features of the invention will become more apparent from the following detailed description when taken in conjunction with the accompanying drawings.

DETAILED DESCRIPTION OF THE INVENTION

Figure 1:
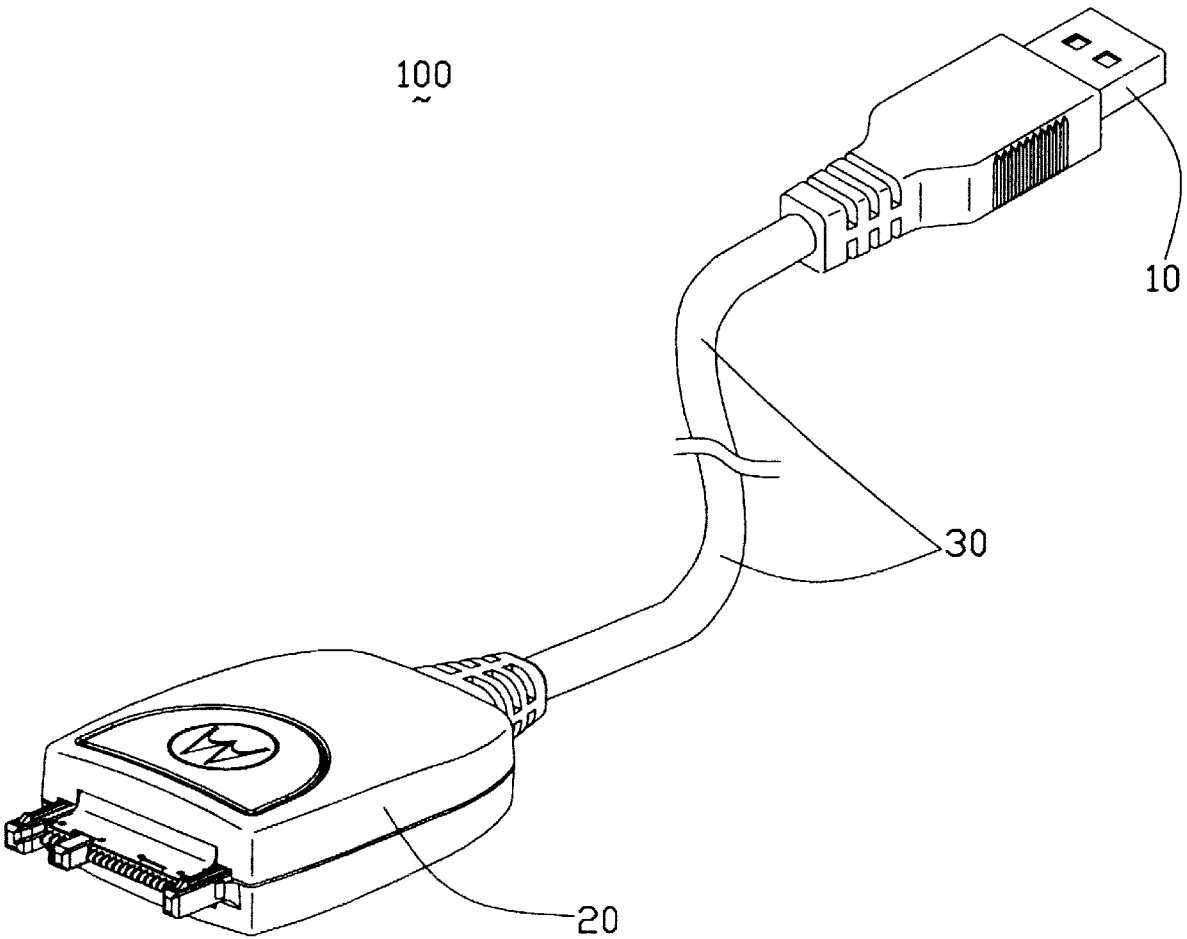
FIG. 1 is a perspective view of an adapter according to the present invention.

Referring to FIG. 1, an adapter 100 according to a preferred embodiment of the present invention comprises a first connector 10, a second connector 20, and a cable 30 electrically connecting the two connectors. The first connector 10 is for electrically connecting to a PC (not shown) and the second connector 20 is for electrically connecting to a portable device (such as a mobile phone, not shown). In the present embodiment, the first connector 10 is a standard USB plug, for electrically connecting to the PC via a standard USB port on the PC. The first connector 10 may also electrically connect to any other device having a standard USB port.

Figure 2:
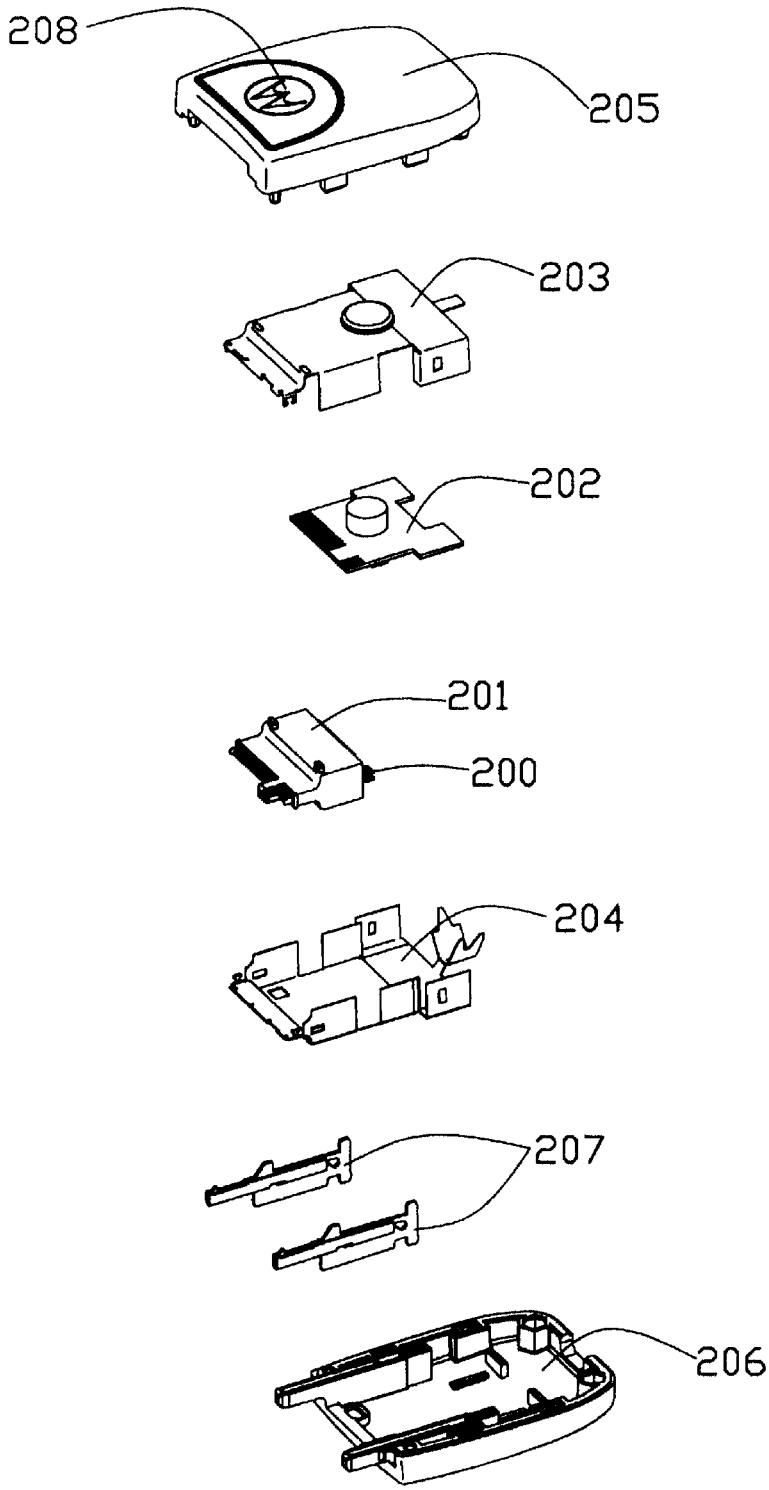
FIG. 2 is an exploded view of a second connector of the adapter in FIG. 1.

Referring to FIG. 2, the second connector 20 of the adapter 100 comprises an insulative housing 201 securing a plurality of contacts 200 therewithin, a printed circuit board (PCB) 202 soldered to the contacts 200, an upper and a lower shields 203, 204 inclosing the housing 201 and the PCB 202, an upper and a lower covers 205, 206, and a pair of latches 207 held in two sides of the lower cover 206. The upper cover 205 has a press portion 208 for actuating the latches 207 to release the second connector 20 from engagement with the portable device. A power converting circuit 40 and a data transmitting circuit 50 (shown in FIG. 3) are disposed on the PCB 202. The second connector 20 may electrically connect to many kinds of portable devices, for example, to mobile phones, to Personal Digital Assistants (PDA), etc.

Figure 3:
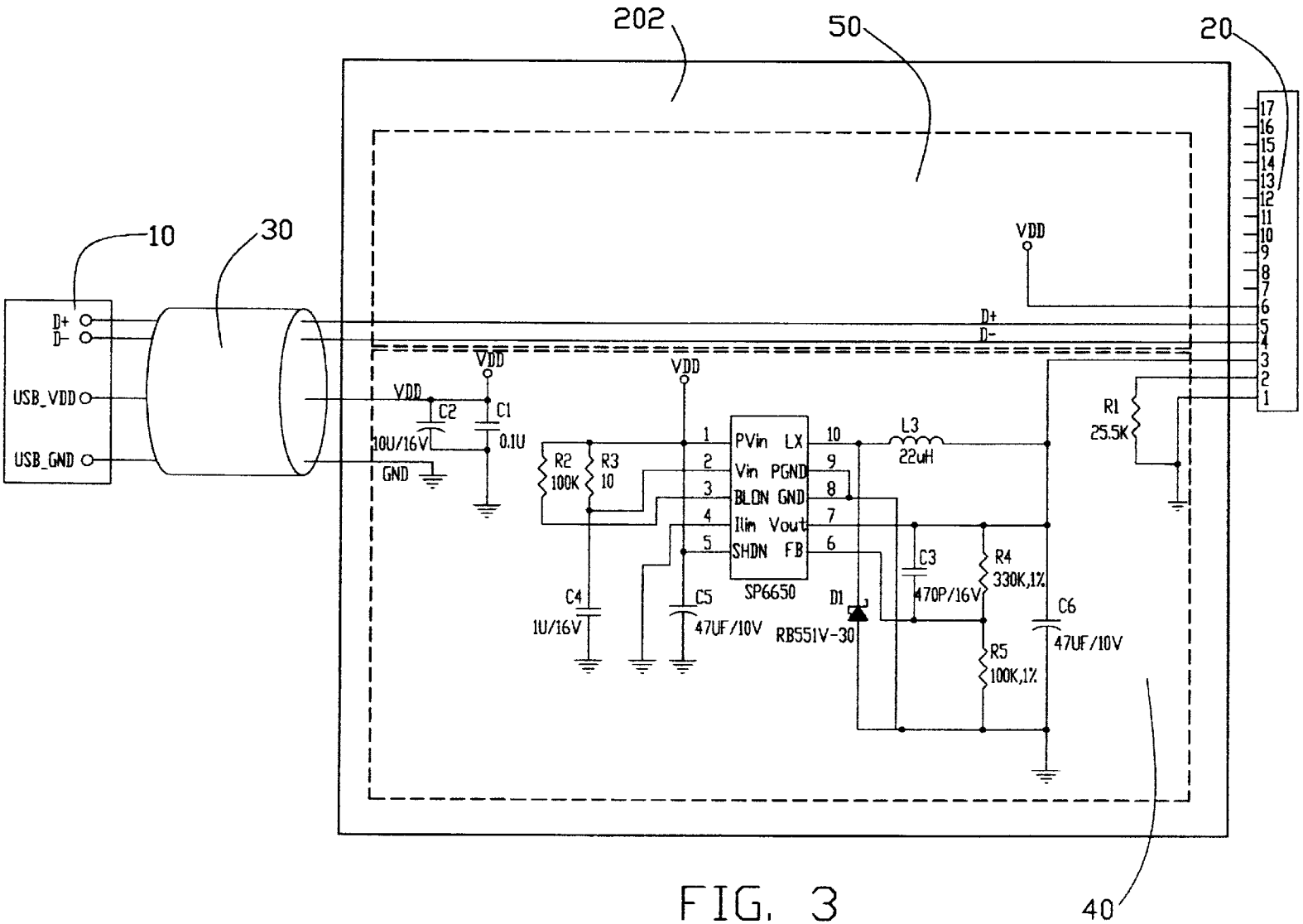
FIG. 3 is a circuit diagram of the adapter in FIG. 1.

Referring to FIG. 3, a circuit diagram of the adapter 100 shows that the first connector 10 has four pins, including a power pin USB_VDD for electrically connecting to a USB voltage at the USB port, a ground pin USB_GND for electrically connecting to a ground, a D+ pin for transmitting or receiving a data signal D+, and a D− pin for transmitting or receiving a data signal D−. The second connector 20 has seventeen contacts, six of which are used in the present embodiment. The remaining contacts are provided for other applications.

The PCB 202 is assembled in the second connector 20. A plurality of wires (not shown) of the cable 30 electrically connect the four pins of the first connector 10 to corresponding contact pads (not shown) on the PCB 202. The contacts 200 in the second connector 20 electrically connect with corresponding contact pads (not shown) on the PCB 202.

The power converting circuit 40 (see FIG. 3) mainly comprises a voltage regulator IC (SP6650, not labeled). The pin 2 of the voltage regulator IC is input and electrically connects to the power pin USB_VDD of the first connector 10 through the cable 30. The pin 7 of the voltage regulator IC is output and electrically connects to the contact 3 (one of the contacts 200 in FIG. 2) of the second connector 20. The ground pin USB_GND of the first connector 10 is electrically connected to ground on the PCB 202 via the cable 30. The contact 2 (one of the contacts 200) of the second connector 20 is electrically connected to ground on the PCB 202. In addition, the contact 1 (one of the contacts 200) of the second connector 20 is electrically connected to ground on the PCB 202 for detecting whether the second connector 20 is correctly mated with the portable device.

The D+ pin and the D− pin of the first connector 10 respectively electrically connect to the contacts 5 and 4 (two of the contacts 200) of the second connector 20 via corresponding wires in the cable 30 and conductive traces (not shown) disposed on PCB 202. Said conductive traces form the data transmitting circuit 50. The contact 6 (one of the contacts 200) of the second connector 20 electrically connects to the power pin USB_VDD of the first connector 10 via conductive traces (not shown) on the PCB 200 to provide a pulse signal for controlling the data transmission.

Therefore, the power pin USB_VDD, the ground pin USB_GND, the D+ pin, and the D− pin of the first connector 10 electrically connect to corresponding contact pads on the PCB 202 via a plurality of wires in the cable 30. The contacts 1, 2, 3, 4, 5, and 6 of the second connector 20 are electrically connected to corresponding contact pads on the PCB 202.

The first connector 10 receives power from the PC, then the power passes through the cable 30 and the power converting circuit 40 to the portable device via contacts 200 in the second connector 20. Data is exchanged between the PC and the portable device via the first connector 10, the second connector 20 (including conductive traces of the data transmitting circuit 50), and the cable 30. So the adapter 100 enables the portable device not only to exchange data with the PC, but also to be charged from the PC simultaneously.

Indeed, the adapter 100 can be connected to any other device having a standard USB port, getting power from the device via the standard USB port, then providing power to the portable device after power conversion.

In addition, the first connector 10 can also use a standard IEEE 1394 (IEEE, Institute of Electrical and Electronics Engineers) plug instead of the standard USB plug, and can connect to the PC or any other device having a standard IEEE 1394 port via a standard IEEE 1394 port thereon. Therefore, power can be provided to the portable device via a standard IEEE 1394 port.

Compared to the prior art, the adapter 100 according to the present invention has a power converting circuit 40 and a data transmitting circuit 50 in the second connector 20, which enables the portable device not only to exchange data with the PC, but also to be charged from the PC at the same time. Thus the portable device is more convenient to use. It is noted that because the second connector 20 is equipped with the internal built-in printed circuit board with both the data transmitting circuits 50 and power converting circuits 40 including components thereof, the length of the second connector may be little bit longer than the regular one which only transmits the data while without the charging function. On the other hand, because of the built-in power circuits of the second connector 20, there is no. need to provide an additional control unit between the first and second connectors. Thus, only a simplex bendable/flexible cable is connected between the first and second connector, and it results in easiness/flexibility of using and/or storing the whole adaptor set. Furthermore, the adapter 100 can be connected to any other device having a port compatible with the first connector 10 of the adapter 100, so can supply power from the device to the portable device for charging. In addition, the adapter 100 has a simple configuration and is easy to use.

It is to be understood, however, that even though numerous characteristics and advantages of the present invention have been set forth in the foregoing description, together with details of the structure and function of the ivention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adapter for connecting a first electronic device to a second electronic device to exchange data and transmit power concurrently therebetween, comprising:

a first connector being electrically connected to the first electronic device;

a second connector being electrically connected to the second electronic device, the second connector including a power converting circuit and a data transmitting circuit disposed therein; and a cable electrically connecting the first connector and the second connector;

wherein power from the first electronic device passes through the first connector, the cable, and the power converting circuit in the second connector to the second electronic device, and the data is exchanged between the first and second electronic devices via the first connector, the cable, and the data transmitting circuit in the second connector.

* * * * *